US010240400B1

(12) United States Patent
Wajnikonis

(10) Patent No.: US 10,240,400 B1
(45) Date of Patent: Mar. 26, 2019

(54) MINI-RISER FOR SCR COILED TUBING AND WIRELINE INTERVENTIONS

(71) Applicant: Krzysztof Jan Wajnikonis, Rosharon, TX (US)

(72) Inventor: Krzysztof Jan Wajnikonis, Rosharon, TX (US)

( * ) Notice: Subject to any disclaimer, the term of this patent is extended or adjusted under 35 U.S.C. 154(b) by 0 days.

(21) Appl. No.: 15/992,027

(22) Filed: May 29, 2018

Related U.S. Application Data

(63) Continuation-in-part of application No. 15/575,598, filed as application No. PCT/US2016/034532 on May 27, 2016, now Pat. No. 10,024,121.

(60) Provisional application No. 62/166,838, filed on May 27, 2015, provisional application No. 62/168,861, filed on May 31, 2015, provisional application No. 62/185,749, filed on Jun. 29, 2015, provisional application No. 62/189,437, filed on Jul. 7, 2015, provisional application No. 62/201,157, filed on Aug. 5, 2015, provisional application No. 62/214,265, filed on Sep. 4, 2015.

(51) Int. Cl.
*E21B 17/01* (2006.01)
*E21B 43/01* (2006.01)
*E21B 19/00* (2006.01)

(52) U.S. Cl.
CPC ..... *E21B 17/015* (2013.01); *E21B 19/004* (2013.01); *E21B 43/0107* (2013.01)

(58) Field of Classification Search
CPC ... E21B 17/015; E21B 19/004; E21B 43/0107
See application file for complete search history.

(56) References Cited

U.S. PATENT DOCUMENTS 4,848,949 A * 7/1989 Castel ..... E21B 43/013 403/12
4,878,694 A * 11/1989 Castel ..... E21B 41/04 285/24
6,386,290 B1 * 5/2002 Headworth ..... E21B 17/01 166/346
6,520,262 B2 * 2/2003 Barnett ..... E21B 33/038 166/339
8,973,665 B2 * 3/2015 Sbordone ..... E21B 33/076 166/345

(Continued)

FOREIGN PATENT DOCUMENTS

WO WO-0130646 A1 * 5/2001 ..... E21B 17/015

OTHER PUBLICATIONS

K.J. Wajnikonis, PCT/US16/34532 amended by IPEA/US + Prelim. Report, Nov. 2, 2016/ Nov. 29, 2016/ Dec. 28, 2016.

(Continued)

*Primary Examiner* — Matthew R Buck

(57) ABSTRACT

A novel configuration of lightly tensioned or substantially untensioned, i.e. substantially compliant mini-riser is provided to facilitate coiled tubing and/or wireline interventions in rigid catenary riser installations. Those can include in particular clearing hydrates that may accidentally plug risers or subsea pipelines connected to those risers. Existing Intervention Y units can be used, or they can be modified to suit design condition of particular installations.
The mini-riser can be used with flexible joint hang-offs, Titanium Stress Joint hang-offs or with novel Spoolflex hang-offs.

18 Claims, 2 Drawing Sheets

(56) References Cited

U.S. PATENT DOCUMENTS

| | | | | |
|---|---|---|---|---|
| 10,024,121 | B2 * | 7/2018 | Wajnikonis | E21B 19/004 |
| 2008/0223583 | A1 * | 9/2008 | Roveri | B63B 27/24<br>166/336 |

OTHER PUBLICATIONS

Intervention-Y Brochure 1.
Intervention-Y Brochure 2.

* cited by examiner

MINI-RISER FOR SCR COILED TUBING AND WIRELINE INTERVENTIONS

This application is a continuation in part application of U.S. Utility patent application Ser. No. 15/575,598 filed on Nov. 20, 2017. This specification claims the benefit of priority related to PCT Patent Application PCT/US16/34532 filed May 27, 2016, U.S. Provisional Patent Applications No. 62/166,838 filed on May 27, 2015 No. 62/168,861 filed on May 31, 2015, 62/185,749 of Jun. 29, 2015, No. 62/189,437 filed on Jul. 7, 2015, No. 62/201,157 filed on Aug. 5, 2015, 62/214,265 of Sep. 4, 2015, and of U.S. Utility patent application Ser. No. 15/575,598 filed on Nov. 20, 2017.

TECHNICAL FIELD

This invention relates to a novel configuration of a mini-riser that can be used for servicing catenary risers fitted with intervention-Y devices mounted in hang-off regions of various types of catenary risers.

BACKGROUND ART

Rigid risers are important devices used in offshore engineering to transfer fluids in both directions between the seabed and the vicinity of the sea surface. In particular production risers are used to transport hydro-carbons from the seabed to fixed and/or floating platforms or vessels.

During the life of production risers the flow of hydrocarbons can be accidentally stopped by formation of hydrate plugs that can be difficult to clear—it may take several months to clear a hydrate plug. Considerable costs can be incurred during the efforts to restore the production that add to the losses caused by the interruptions in the production.

Intervention-Y units are occasionally installed on catenary production risers in order to facilitate coiled tubing and/or wireline operations. Coiled tubing and/or wirelines can be used to clear hydrate plugs for example by dissolving them with methanol. The Intervention-Y installations are generally regarded as optional and are rare. They are however missed when they become necessary and are not installed. The reasons for the above mentioned rare use are two-fold:

- additional investment costs,
- there is at present no easy, established way of utilizing the intervention-Ys.

Steel catenary riser hang-offs tend to be located near the keel depths of floating platforms (approximately 100 ft to 300 ft below the sea surface), and Intervention Ys are difficult to access from the surface through the layers of the water column typically featuring the strongest wave and current actions. Adding intervention-Ys to existing risers later during the life of the field may be difficult and costly, even if feasible.

At this time two known approaches tend to be considered while adding a servicing riser between an Intervention Y unit and installations on the surface:

- A provisional multi-span riser installation,
- A provisional tensioned riser/jumper installation (for example approximately 200 kip top tension).

Neither of the about provisional methods are straightforward. It may be difficult to provide provisional locations for supporting clamps. Also Steel Catenary Risers (SCRs) tend to be inclined around 10° to the vertical in the regions of their hang-offs and the change of direction between that tangent to the SCR pipe and the service flange of an Intervention Y and the vertical direction required for access to the servicing equipment above the sea surface. Often the proximity of essentially vertical platform column, truss structure, pontoon or side wall often come in the way. The above listed types of difficulties often arise when either of the above listed provisional riser installations are considered. For a provisional tensioned riser/jumper an additional difficulty may be on the side of the structural strength limitations of an Intervention Y already installed.

The mini-riser configurations suggested herein are designed to overcome the above highlighted difficulties.

Intervention Ys considered herein are those suitable to be installed on rigid catenary risers, or metallic catenary risers, SCRs, Lazy Wave SCRs or Steel Lazy Wave Risers (SLWRs), or a titanium catenary risers, or a Chinese lantern risers, or a bottom weighed risers, or a fiber reinforced plastic catenary risers, or a fiber reinforced plastic lazy wave risers.

Rigid catenary risers, or metallic catenary risers, SCRs, Lazy Wave SCRs or SLWRs, or a titanium catenary risers, or a Chinese lantern risers, or a bottom weighed risers, or a fiber reinforced plastic catenary risers, or a fiber reinforced plastic lazy wave risers are essentially variations of SCRs and without a use of Intervention Ys like those described herein coiled tubing or/and wireline operations would not be possible in those risers. It is known to anybody skilled in the art that all the above highlighted risers generally connect to subsea pipelines provided on their other ends with Pipeline End Manifolds (PLEMs), Pipeline End Terminations (PLETs) or skids used to connect subsea pipelines to continuing subsea pipelines. Those in turn are usually connected to subsea wells using jumpers.

It is also known to anybody skilled in the art that subsea wells can be accessed from the surface using tensioned or freestanding drilling, completion or workover risers that allow direct drilling, coiled tubing, wireline operations and tool access essentially vertically from the surface using standard intervention equipment. However, accessing subsea pipelines from the side of subsea wells is even more difficult than it is from the tops of rigid catenary risers, or a metallic catenary risers, SCRs, Lazy Wave SCRs or SLWRs, or a titanium catenary risers, or a Chinese lantern risers, or a bottom weighed risers, or a fiber reinforced plastic catenary risers, or a fiber reinforced plastic lazy wave risers, and that provides an option for utilizing mini-risers according to this invention.

It immediately follows for anybody skilled in the art that intervention operations using top tensioned or freestanding risers in subsea wells or in surface wells are not of a concern with regard to the use of this invention.

DISCLOSURE OF INVENTION

This invention involves a mini-riser connected by a lower end of said mini-riser to a service flange of an Intervention 'Y' fitting designed for coiled tubing or wireline operations, said Intervention 'Y' fitting designed for said coiled tubing or said wireline operations installed in a general area of and connected to a top of a riser including at least one of a rigid catenary riser, or a metallic catenary riser, or a steel catenary riser, or a or a steel lazy wave riser, or a titanium catenary riser, or a Chinese lantern riser, or a bottom weighed riser, or a fiber reinforced plastic catenary riser, or a fiber reinforced plastic lazy wave riser and said mini-riser is connected above a water surface by an upper end of said mini-riser to a servicing deck attached to at least one of a platform, or a spread moored vessel, or a turret moored vessel, or a disconnectable turret vessel, or an offshore support vessel, or a diving support vessel, or a multipurpose support vessel, or a barge, or a floating buoy, or a submerged buoy, whereas said mini-riser is substantially compliant between said upper end of said mini-riser and said lower end of said mini-riser.

This invention involves a riser assembly comprising:

an Intervention 'Y' fitting designed for coiled tubing or wireline operations, a mini-riser connected by a lower end of said mini-riser to a service flange of said Intervention 'Y' fitting designed for said coiled tubing or said wireline operations, said Intervention 'Y' fitting designed for said coiled tubing or said wireline operations being installed in a general area of and connected to a top of a riser including at least one of a rigid catenary riser, or a metallic catenary riser, or a steel catenary riser, or a steel lazy wave riser, or a titanium catenary riser, or a Chinese lantern riser, or a bottom weighed riser, or a fiber reinforced plastic catenary riser, or a fiber reinforced plastic lazy wave riser;

wherein said mini-riser is connected above a water surface by an upper end of said mini-riser to a servicing deck attached to at least one of a platform, or a spread moored vessel, or a turret moored vessel, or a disconnectable turret vessel, or an offshore support vessel, or a diving support vessel, or a multipurpose support vessel, or a barge, or a floating buoy, or a submerged buoy, and wherein said mini-riser is substantially compliant between said upper end of said mini-riser and said lower end of said mini-riser.

Novel mini-risers can be built out of steel, duplex, superduplex, nickel based alloys, Corrosion Resistant Alloys (CRAs), etc. or from other high elastic modulus high strength materials. They can be lined, clad or weld-overlaid with other materials like the above listed materials, including the CRAs.

Optional Intervention 'Y' fittings ('Ys') used with this invention need to be able to sustain static and dynamic loads in the mini-risers, platform piping or in novel Spoolflex hang-off jumpers, see U.S. Utility patent application Ser. No. 15/575,598 filed Nov. 20, 2017 and herein. An alternative name also used herein (and previously) to describe novel Spoolflex hang-offs is Short Jumper Spool (SJS) hang-offs.

BRIEF DESCRIPTION OF THE DRAWINGS

A selection of multiple implementations of this invention is illustrated on FIGS. 1 and 2.

MODES OF CARRYING OUT THE INVENTION

Figure 1:
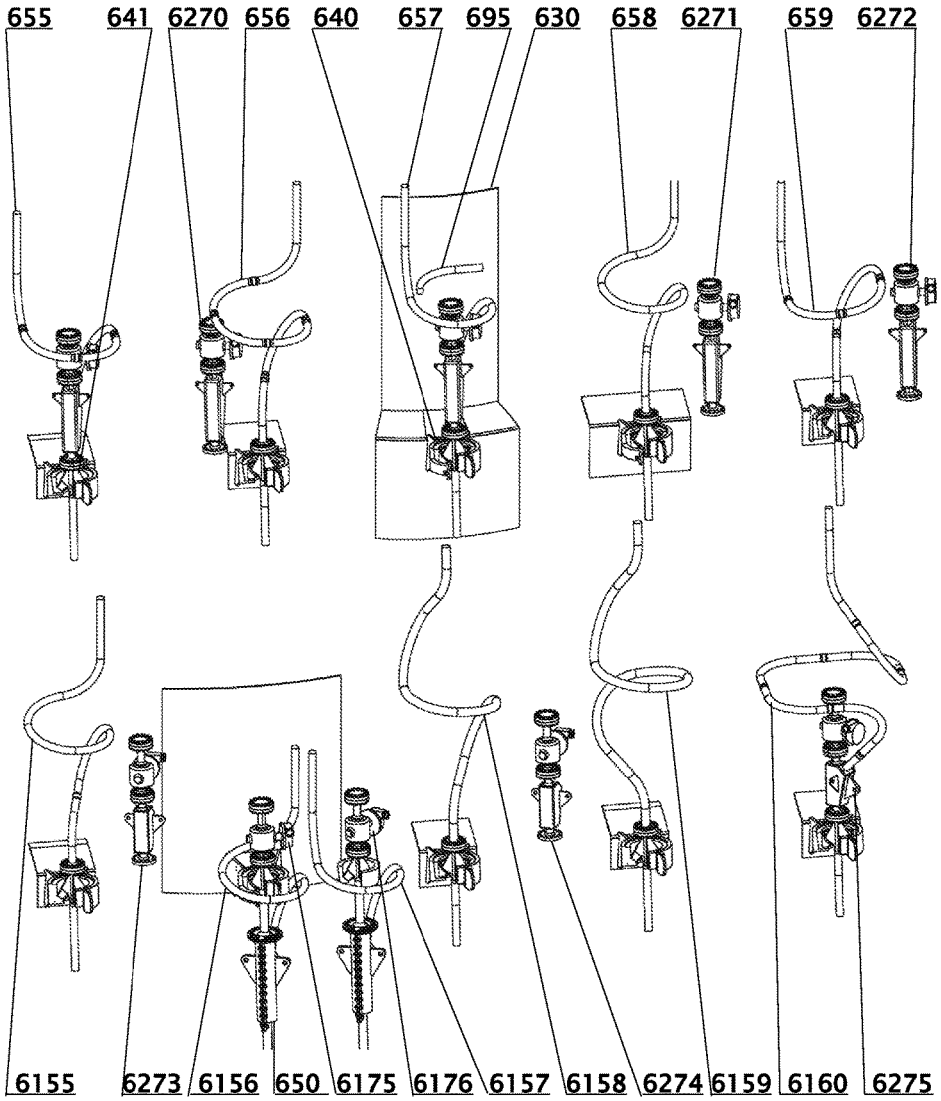
FIG. 1 depicts schematically examples of uses of Intervention Ys with multiple novel Spoolflex hang-off configurations used on various offshore structures. Intervention Ys are depicted as installed and/or as options for possible installations. The uses of Intervention Ys with known SCR Hang-offs like SCR type flexible joints or Titanium Stress Joints (TSJs) in general on a tapered transition joint are analogous and they are not depicted herein, because they are well known to those skilled in the art.
Figure 2:
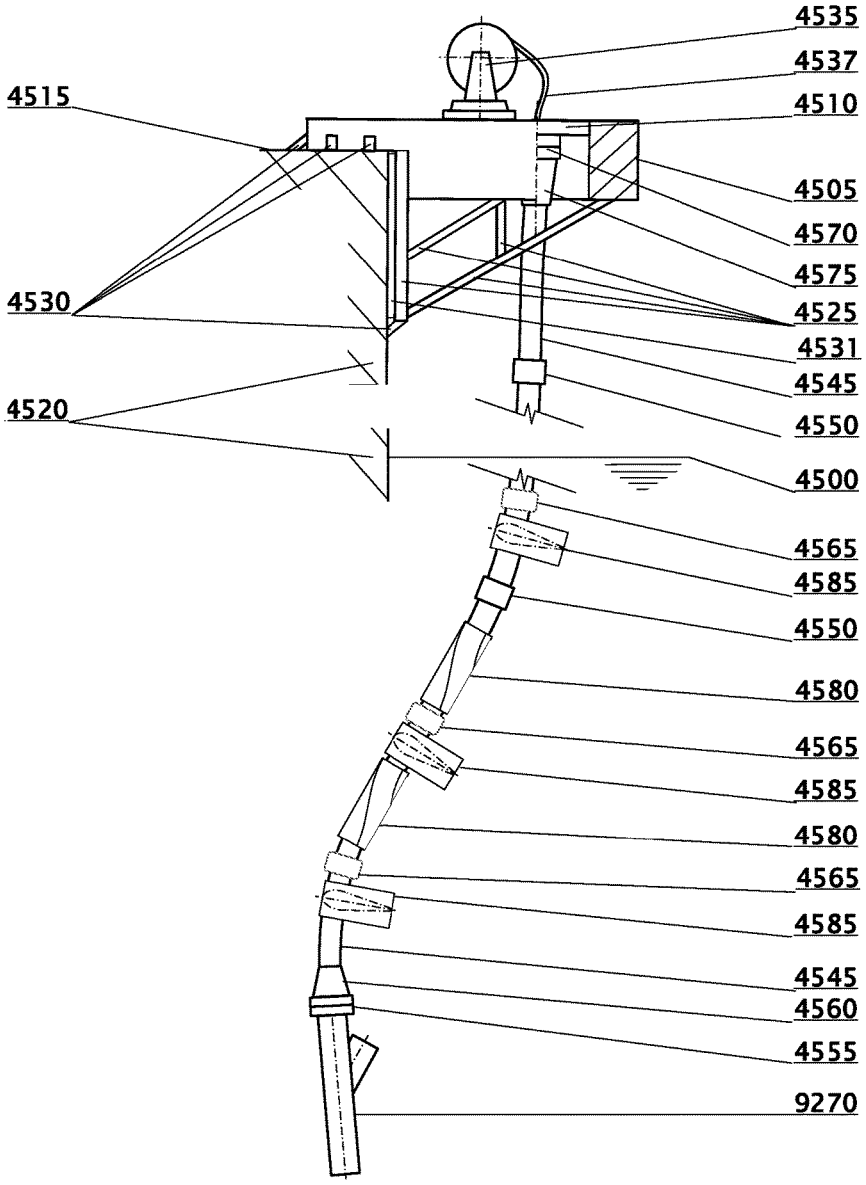
FIG. 2 depicts schematically a configuration of a novel mini-riser system suggested for coiled tubing or wireline interventions into risers for use with Intervention 'Ys'.

This invention is explained further by reference to FIGS. 1 and 2.

FIG. 1 depicts schematically Spoolflex (SJS) 655 through 659 and 6155 through 6160 used in riser hang-off configurations on various types of floaters. SJSs shown can be used on any kind of floaters discussed herein, and on turrets, disconnectable buoys, floating buoys or submerged buoys 630.

SJSs 655, 656 and 659 use very short straight segments between bends, just long enough to use connectors. Non-descending SJSs 655, 656 differ with the number of 90° bends incorporated in their partial loops—one for SJS 655 and two for SJS 656. SJSs 655, 656, 657, 658, 6155, 6156 and 6157 are ascending. SJS 659 features an ascending/descending configuration with a part of its entry spool, the one bend partial loop and a part of its exit spool having negative slope angle in the floater system of coordinates. SJSs 6158, 6159 and 6160 feature ascending/descending geometries, whereas the top parts of exit spools shown are arranged along lines tangent to their risers corresponding at the pivot locations. Such configurations can be rotated around the common riser—end of exit spool axes to arbitrary azimuth angles for more convenient design. In fact the essentially ascending/descending designs of SJS 6158 and 6159 feature considerable reductions of the absolute values of the negative slopes and of the lengths of the negatively sloped segments because of such rotations in comparison with their original design orientation (not shown) that was similar to the entry spool orientation of SJS 6160. SJSs 6156 and 6157 demonstrate that all the SJSs shown on FIG. 1 can be optionally suspended with help of hang-off clamps 650. SJS 6160 features considerably larger footprint than do the other SJSs featured on FIG. 1.

SJSs 657, 658, 6155, 6156, 6157, 6158 and 6159 feature the minimum footprints feasible while utilizing 5.OD bends—they have no straight segments in the partial loops, where applicable or between the entry spool, the partial loop and the exit spool, where applicable. SJSs 6158 and 6159 use slightly bigger outside diameter than do all the other SJSs featured herein and their dimensions are proportionally bigger. Exit spool 695 shows an alternative exit spool configuration that is one of exit spool configurations feasible with most SJSs shown on FIG. 1.

Optional Intervention 'Ys' 6270, 6271, 6272, 6273, 6274 and 6275 depicted demonstrate that the use of Intervention 'Ys' may be feasible for all the configurations herein that do not utilize hang-off clamps 650. For the latter configurations it can be in some cases feasible to incorporate a part of Intervention 'Y' fittings with the diverter inside hang-off clamps 650 and to place service valve unit 6175, 6176 on top of the pivot arrangements. Ball joint pivots 640, flex joint pivots 641, gimbal pivots 142, 242, 342, 442 and many other pivot arrangements can be used to replace the pivot arrangements depicted on FIG. 1. All SJSs shown on FIG. 1 can optionally utilize hang-off clamps 550 and most can utilize optional Intervention 'Ys' 6270, 6271, 6272, 6273, 6274 subject to the availability of essentially straight access above the 'Ys'.

FIG. 2 shows schematically an optional configuration of rigid catenary riser or SCR servicing equipment that can be used during coiled tubing or wireline interventions.

Optional Intervention 'Y' fitting 9270 is shown schematically on FIG. 2, the SCR, the riser porch and the platform piping or SJS are omitted for clarity. Sea Water Level (SWL) 4500 is shown schematically on FIG. 2.

Catenary riser (SCR, SLWR, etc.) intervention service unit 4505 is mounted directly or indirectly in a region of deck 4515 or on deck 4515 of vessel 4520 and it is optionally supported on the vessel side or on other structure structurally associated with vessel 4520. The vessel can be the production platform supporting the catenary riser to be serviced, like a semisubmersible, TLP, Spar, etc., an FPSO, etc., an auxiliary support/servicing vessel or a barge stationary in the vicinity of the production vessel. The production and the auxiliary/servicing vessel may or may not be moored to each other. Dynamic positioning can be used.

Catenary riser intervention service unit 4505 is represented on FIG. 2 schematically, structural details of its construction are typical and they can be specified for any particular sets of functional requirements and design loads by anybody skilled in the art.

Vessel (platform) side 4520 is also represented schematically on FIG. 2. Catenary riser intervention service unit 4505 has its geometrical configuration, structural design and structural supports customized in each installation case to be compatible with that of vessel 4520. In case of 'portable' generic intervention service unit 4505, specific shape and structural support modifications would typically be made in order to customize the design and the geometry of intervention service unit 4505 for specific catenary risers (SCRs, flexible risers, etc.) and for use at any specific installation location on a vessel. Structural details of such modifications are typical and they can be specified for any particular sets of functional requirements and design loads by anybody skilled in the art. Engineering standards, like for example API RP 2A, and specifications used must be complied with at all times.

Catenary riser intervention service unit 4505 can be dedicated to servicing a particular SCR or a group of SCRs, or it can be generic, portable, designed for general use with various catenary risers. The SCRs serviced can be provided with flexible SJS hang-offs according to this invention, they can be used on traditional SCRs supported with flex joints or TSJs, or they can be flexible risers (bonded or unbonded).

Catenary riser intervention service unit 4505 depicted schematically on FIG. 2 is mounted on a vessel using supporting structure 4525 of arbitrary design and welded or otherwise attached directly or indirectly to a deck of vessel 4515 and to vessel side 4520 or to other structure associated structurally with vessel 4520 using optional brackets 4530. Instead of a side of the vessel, the servicing equipment can be also located in a moonpool of vessel 4520 or in its general area. Supporting structures such as 4525 and welding brackets such as 4530 are typical items used offshore and principles of their design are well known to those skilled in the art. Optional bearing pad(s) 4531 can be used. Supporting structures such as 4525 and welding brackets such as 4530 are designed to adequately interact with the vessel structure, including its frames, stiffeners, plating, etc. If necessary optional strengthening plates, etc. (including gusset plates) can be welded to the vessel deck and/or side and/or inside the vessel structure. Additional, optional strengthening members can be added as well. Supporting structure 4525 can be attached to any vessel deck, at a general area of any vessel deck or to any part of the vessel structure, as convenient for the intervention operations. The design needs to take into account the safety of all operations, the shape to be assumed by mini-riser 4545 during the intervention operations, the ease of installation of all intervention equipment, crane access, handling equipment and functional considerations, etc.

Coiled tubing 4537 or wireline (also 4537, not shown) is stored and deployed from storage/deployment package 4535. Package 4535 incorporates all the necessary servicing equipment that is not represented in detail on FIG. 2. That equipment may involve an injector, a lubricator (whether or not deployed above or below the sea surface), the coiled tubing reel, all the electrical, mechanical, hydraulic, etc. power units, measuring, monitoring and control equipment, etc. Those will be deployed on decks of vessel 4520 or on other barges or vessels as practicable. Mini servicing riser 4545 used for interventions is suspended from servicing deck or servicing table 4510. Mini-riser 4545 can be made up and run using connectors 4550 or it can be made of flexible pipe and deployed from a reel, in cases where the design conditions allow that. The mini-riser joint making up equipment (if installed at all, it may be optional), optional flexible deployment reel equipment and all other hardware required are omitted from this schematic drawing for simplicity. The running of the mini-riser can be also carried out from a platform dry tree moonpool and 'keel-hauled' outboard in an essentially vertical configuration for installation in place. If available it can be also run from a drilling vessel, a J-lay tower or a portable drilling rig. Whether or not the installation opportunities highlighted above are or are not readily available, other and often more economical mini-riser installation arrangements (see further below) can be used instead.

Intervention operation described herein can be carried out using existing Intervention 'Y' fitting 9270, or Intervention 'Y' can be retrofitted on any installation originally constructed without it. Retrofitting of Intervention 'Y' fitting 9270 must be carried out consistently with widely used repair or/and equipment upgrade good practice and procedures that are obvious to anybody skilled in the art.

In particular, before any existing spool is removed:

- the line must be depressurized,
- internal fluids must be removed from the platform piping and at least the top segments of the riser,
- the disassembly area must be internally separated with effective separation plug or plugs;
- the piping and the riser must be scrapped and internally cleaned;
- external areas must be cleaned;
- etc., consistently with best engineering and subsea operation practice, legal requirements, engineering standards and specifications approved by the Company and Classification Societies, as it is well known to those skilled in the art.

After any interfering platform piping or SJS entry spool segments are removed, the catenary riser flange (typically above a flex joint, TSJ or flexible riser hang-off) is prepared to accept optional Intervention 'Y' fitting 9270, or in a case there is no plan to retrofit one, bottom fitting 4560 of mini servicing riser 4545 can be installed directly on top of the catenary riser flange (typically above a flex joint, TSJ or flexible SJS riser (Spoolflex) hang-off, not shown).

Subsequently a new shortened piping spool can be connected between Intervention 'Y' fitting 9270 and the platform piping. Whenever there is no plans to use an optional Intervention 'Y' fitting 9270, the coiled tubing or wireline servicing operations can be carried out and after those are completed, and the replacement piping spool or the original spool removed for the servicing operation can be reinstalled.

In a case existing optional Intervention 'Y' fitting 9270, as installed, is structurally inadequate to support design loads on the intervention equipment, an optional support clamp (not shown for clarity) can be installed between the Intervention 'Y' fitting at the general area of the low end of the mini-riser. The optional support clamp can be attached directly to the vessel structure, the vessel side included, it can utilize the riser porch or riser bank for support, etc. In cases where there may be difficulties in designing conventional type of a support, a cradle like support can be used. A cradle like support can utilize a configuration of one, two, three, four or more, etc. strengthening legs resulting in monopod, bipod, tripod, or four or more strengthening legs, etc., whereas the legs can be straight or curved legs, optional strengthening members can be added, etc. Support structures like those described above can be used on traditional installations of catenary risers including SCR installations utilizing SCR types of flex joints and TSJs, where Intervention 'Y' fittings are designed as fixed relative the vessel structure. Any known attachment means can be used where acceptable as required with the supporting structure or structures. Those may include clamping, bolting attachments, thermite welding, helium or argon shield welding, laser beam welding, hyperbaric welding, friction welding, etc. For simplicity new Intervention 'Y' fitting installations can be optionally fitted with the supporting structures or they can preferably be designed to sustain all design loads without a need for use of optional support structure(s).

In cases where flexible SCR hang-off featuring SJS(s) according to this invention is used Intervention 'Y' fitting 9270 is fixed to the SCR and it undergoes rotational deflections together with the top of the SCR. In such installations Intervention 'Y' fitting must be designed to sustain full design loads imposed on the intervention equipment, or the 'vessel side' ends of the supporting cradle, including monopods, bipods, tripods, four or more leg structures, etc. must be fixed, directly or indirectly, to the SCR flange and rotate with the SCR tops, as the SCR deflects relative the vessel structure.

It is obvious to anybody skilled in the art that Intervention 'Y' fitting does not need to be designed for the full survival range of rotational deflections, for which the hang-off is designed. In a case a tropical cyclone (hurricane) or other storm passage, extreme loop current event passage, etc. is expected, etc. mini servicing riser 4545 would be disconnected from the Intervention 'Y' fitting, etc., and all the equipment secured. In such conditions mini servicing riser 4545 could be also optionally disconnected from its service unit 4505 as required. It can be subsequently retrieved on deck of the vessel or platform, a support vessel, etc., it can be wet stored on the seabed, fitted with additional floatation on one end and anchored to the seabed or moored to other subsea equipment and stored at a safe water depth until the tropical cyclone or other condition, etc. has passed.

The design shape for mini servicing riser 4545 to assume should be as direct and straight as possible, but in general a gentle 'S' shape may be unavoidable, as shown on FIG. 2. The top segments of SCRs are generally inclined at various angles to the vertical (often close to 10°), but flexible risers can be inclined to the vertical at both larger and smaller angles. Mini servicing riser 4545 should be as closely aligned with the riser axis as possible, which will often favor a use of pre-bent lower joint or joints. A use of such pre-bend joints is one of the reasons for designing mini servicing riser 4545 for small effective tensions, which is recommended where feasible (see further below).

Mini servicing riser 4545 would preferably be lead outboard of all the vessel structure, vessel piping, etc., but exceptions from that recommendation are by all means acceptable. For example a part of the mini-riser can be lead inside a truss structure of a truss Spar, inside some piping, etc. Where that is the case, the entire mini servicing riser may be 'threaded' along its installation path required during the installation operation, or it can be installed in segments. In the latter case some connectors 4550 may be made-up after all segments of mini-riser 4545 have been located essentially along their desired installation path.

Connectors 4550 can be of any type convenient. Simple threaded 'drill-pipe' like connectors can be used, Merlin™ connectors or their third party competitors, upgrades of the Merlin™ family connectors designed to transfer high torsional loads structurally, flanged connections, connectors with mating sides clamped together, collet connectors, etc. can be used, as functionally acceptable.

In a case any curved or straight segment(s) of mini-riser 4545 come into a proximity to the vessel structure, to any piping, I-Tubes, etc. one or more clamping devices well known to those skilled in the art can be used. In some cases a use of temporary distance clamping may be acceptable and recommended in order to prevent rubbing or clashing. It may be acceptable to use (a) light weight provisional type(s) of clamp(s) for that purpose, if acceptable according to Company guidelines and standard engineering practice. Optionally the temporary distance clamping arrangement may have compliant characteristics. It may be acceptable to use elastomeric material(s), fiber reinforced or not reinforced plastic materials to build such temporary clamp(s), wood for components loaded in compression only, high strength webbing straps (like those made off aramid fibers, ultra high molecular weight polyethylene like Spectra, Amsteel, etc. for attachments, etc. It is recommended that in cases where webbing, fiber ropes, etc. is (are) used for attachment, such attachment provisions should include independent components at least doubled for redundancy. For example a temporary clamping arrangement should include at least two independent webbing sets for the attachment to the mini-riser, two independent webbing sets for the attachment to the vessel structural element and two independent webbing, steel cable, etc. sets wound around, in a 'figure eight' or equivalent temporarily clamping directly the mini-riser and the vessel structural element in the area of the temporary clamp. The webbing or other arrangement may be optionally designed and calibrated for automatic disconnection or rapture in a case of an accidental overload. Calibrated 'weak link(s)' can be used for that purpose. It is understood here, that if acceptable at all, such temporary clamp(s) would not necessarily carry any important structural loads; they could be essentially used as distance spacers, or similar.

In a case an intervention is carried out with a riser or a subsea pipeline blocked internally, all the preparation operations including pigging must be safely carried out from the top end, as if the riser system were not piggable. For safety reasons all the upstream pressures should be blead before the intervention operations or extra secure safety plugs must be installed internally in order to safely separate any possibly pressurized segments of riser/flowline system.

An economical way to install mini-riser 4545 is to assemble the mini-riser on deck of a small barge or support vessel. Mini-riser 4545 can be provided with additional buoyancy, and launched from deck in the S-lay mode. Davit-lift like assembly or an assembly utilizing provisional outboard outriggers can be carried out instead outboard of a small barge or a support vessel, etc. The above or similar techniques can be used in order to gradually launch the mini-riser to a surface or an off-surface mode. Launching from deck can be used, or an optional ramp can be used that can be inclined or not inclined at an acute angle to the deck. Onshore connection and launching from a beach or from a quay would work as well. If applicable the mini-riser can be towed from the onshore or offshore launching location, to the field, up-ended and connected to the Intervention 'Y' fitting. All these and other installation methods are well known to those skilled in the art and need not be described further.

Mini-riser 4545 can utilize rigid joints, like for example metallic joints made of titanium, steel, nickel based alloys, aluminum, etc. Mini-riser joints can be also made of Fiber Reinforced Plastics (FRPs) that utilize carbon fiber, graphite fiber, aramid (including Kevlar®) fiber, glass fiber, etc. The use of titanium, FRP joints or flexible pipe is preferred because of their superior bending flexibilities. Achieving a suitable bending flexibility of mini-riser 4545 is the key objective of this design. Mini-riser 4545 is suspended from the top using connector 4570 (or flange).

It is recommended that mini-riser 4545 be very lightly tensioned, where acceptable, i.e. that the effective tension at the Intervention 'Y' fitting connector 4555 (or flange) be close to zero, so that the mini-riser remains compliant in all its design conditions. If necessary and safe from environmental protection point of view connector 4555 should be designed for an automatic disconnection in a case of exceeding its design parameters, like for example maximum tension or/and the maximum deflection angle between the min-riser and the axis of the service branch of Intervention 'Y' 9270 and any line pressure must be contained. Such a provision may be necessary for example in a case servicing unit 4505 is supported by a different vessel than that on which the catenary riser is installed. In such a case one or two gate valve(s), if used, in Intervention 'Y' fitting 9270 may be customized for emergency shearing of coiled tubing or wireline inserted into mini servicing riser 4545. Other disconnection arrangements can also be used.

Mini-riser 4545 be also lightly tensioned, with maximum effective tension along its length not exceeding for example 2.5 times, or between 5 and 15 times the submerged weight of mini-riser 4545 provided with all equipment it is designed to be used with.

Covering mini-riser 4545 with positively buoyant coating and/or floatation clamps 4565 in order to achieve the desired tension distribution along its length, which in particular could be essentially neutrally buoyant, or it could be tensioned by its controlled self-weight submerged. The effective length deployed is controlled with appropriate selection of the lengths of the joints deployed, including pup-joints, but additional fine adjustments of the length on mini-riser 4545 can be made by utilizing optional spacer or spacers, optional jacking equipment (hydraulic, screw type, etc.). Mini-riser can be optionally top tensioned, if desired so. Optional top tensioning arrangement (not shown) can be used for that purpose, if required.

The ends of mini-riser 4545 can be optionally provided with stepped or tapered stress joints, bending stiffeners, bending restrictors, etc., as required, item 4560 at the bottom end and/or item 4575 at the top end. In a case mini-riser 4545 is designed to service a range of different sizes of catenary risers, its low end connection 4555 incorporates an adapter to fit any particular flange of the equipment serviced (not shown separately). The adapter will incorporate in its design suitable gradual transition in its internal diameter.

Optional protection from VIVs, if required, can be provided by strakes or 3-D dampers 4580, fairings 4585 or any other effective VIV suppressor or protector. Mini-riser 4545 or its segments can be also designed to be sheltered from the action of wave and currents.

All the components of the mini-riser systems have to be designed with care and safety in mind. Utilizing relevant sections of industry workover riser codes, recommended practices and specifications should be consulted and used, wherever applicable.

Oil States Industries, Inc. (OSI) for example provide designs of Intervention 'Y' fitting and diverter plug removal tooling. That OSI equipment, or similar equipment can be used with this invention, or design modifications to OSI, or similar, Intervention 'Y' fittings can be included in the design. Also it may be feasible to design coiled tubing mounted tooling for optional removal of the diverter plug from the Intervention 'Y' fitting from the surface using mini service riser 4545 for access, instead of using equipment that is already available commercially. Any other suitable catenary riser intervention arrangement can be used instead of that depicted on FIG. 2, if so desired.

This invention involves a mini-riser connected by its lower end to a service flange of an Intervention 'Y' fitting, said Intervention 'Y' fitting installed in a general area of and connected to a top of a riser including at least one of a rigid catenary riser, or a metallic catenary riser, or a steel catenary riser, or a titanium catenary riser, or a Chinese lantern riser, or a bottom weighed riser, or a fiber reinforced plastic catenary riser, or a fiber reinforced plastic lazy wave riser, or a flexible riser and said mini-riser is connected above a water surface by an upper end of said mini-riser to a servicing deck attached to at least one of a platform, or a spread moored vessel, or a turret moored vessel, or a disconnectable turret vessel, or an offshore support vessel, or a diving support vessel, or a multipurpose support vessel, or a barge, or a floating buoy, or a submerged buoy, whereas said mini-riser is compliant between its said upper end and its said lower end.

INDUSTRIAL APPLICABILITY

Novel mini-risers can be used for any coiled tubing or wireline applications necessary, and in particular for clearing hydrate plugs from rigid catenary risers and from subsea pipelines connected to those risers.

The mini-riser for riser intervention system suggested compliments the existing intervention technology. It allows carrying out coiled tubing and wireline interventions from above the sea surface and it can be designed as adjustable, portable and compatible with many types of floating production systems.

What is claimed is:

1. A riser assembly comprising:

an Intervention 'Y' fitting designed for coiled tubing or wireline operations, a mini-riser connected by a lower end of said mini-riser to a service flange of said Intervention 'Y' fitting designed for said coiled tubing or said wireline operations, said Intervention 'Y' fitting designed for said coiled tubing or said wireline operations being installed in a general area of and connected to a top of a riser including at least one of a rigid catenary riser, or a metallic catenary riser, or a steel catenary riser, or a steel lazy wave riser, or a titanium catenary riser, or a Chinese lantern riser, or a bottom weighed riser, or a fiber reinforced plastic catenary riser, or a fiber reinforced plastic lazy wave riser;

wherein said mini-riser is connected above a water surface by an upper end of said mini-riser to a servicing deck attached to at least one of a platform, or a spread moored vessel, or a turret moored vessel, or a disconnectable turret vessel, or an offshore support vessel, or a diving support vessel, or a multipurpose support vessel, or a barge, or a floating buoy, or a submerged buoy, and wherein said mini-riser is substantially compliant between said upper end of said mini-riser and said lower end of said mini-riser.

2. The riser assembly according to claim 1, wherein the Intervention 'Y' fitting designed for the coiled tubing or the wireline operations is installed on a steel catenary riser type flexible joint.

3. The riser assembly according to claim 1, wherein the Intervention 'Y' fitting designed for the coiled tubing or the wireline operations is installed on a tapered transition joint.

4. The riser assembly according to claim 1, wherein the Intervention 'Y' fitting designed for the coiled tubing or the wireline operations is installed on a Titanium Stress Joint.

5. The riser assembly according to claim 1, wherein the Intervention 'Y' fitting designed for the coiled tubing or the wireline operations is used with a Spoolflex jumper.

6. The riser assembly according to claim 1, wherein the Intervention 'Y' fitting designed for the coiled tubing or the wireline operations is incorporated in a hang-off clamp of a Spoolflex jumper.

7. The riser assembly according to claim 1, wherein the mini-riser utilizes rigid joints, including metallic joints made of titanium, or steel, or nickel based alloys, or aluminum.

8. The riser assembly according to claim 1, wherein the mini-riser utilizes fiber reinforced plastics that utilize carbon fiber, or graphite fiber, or aramid fiber, or glass fiber.

9. The riser assembly according to claim 1, wherein the mini-riser utilizes steel, or duplex, or super-duplex, or nickel based alloys, or corrosion resistant alloys.

10. The riser assembly according to claim 1, wherein the mini-riser can be lined, or clad, or weld-overlaid with steel, or with duplex, or with super-duplex, or with nickel based alloys, or with corrosion resistant alloys.

11. The riser assembly according to claim 1, wherein an effective tension is essentially designed to be close to zero essentially in a region of the lower end of the mini-riser.

12. The riser assembly according to claim 1, wherein a maximum effective tension along the mini-riser does not exceed 15 times a submerged weight of said mini-riser.

13. The riser assembly according to claim 1, wherein a pre-bend segment is used in a region of the lower end of the mini-riser.

14. The riser assembly according to claim 1, wherein one or more clamping devices are used on the mini-riser.

15. The riser assembly according to claim 1, wherein one or more vortex suppression devices are used on the mini-riser.

16. The riser assembly according to claim 1, wherein the mini-riser is at least partly sheltered from actions of waves and currents.

17. The riser assembly according to claim 1, wherein the upper end of the mini-riser is supported from a vessel on which the Intervention 'Y' fitting designed for the coiled tubing or the wireline operations is installed.

18. The riser assembly according to claim 1, wherein the upper end of the mini-riser is supported from a different vessel than a vessel on which the Intervention 'Y' fitting designed for the coiled tubing or the wireline operations is installed.

* * * * *